United States Patent [19]

Flueli et al.

[11] Patent Number: 4,741,485

[45] Date of Patent: May 3, 1988

[54] WINDER LAYOUT

[75] Inventors: Adolf Flueli; Claudio Molteni; Jürg Neff; Heinz Oswald, all of Winterthur; Beat Ruf, Hettlingen; Kurt Schefer, Winterthur, all of Switzerland

[73] Assignee: Rieter Machine Works, Ltd., Winterthur, Switzerland

[21] Appl. No.: 941,418

[22] Filed: Dec. 15, 1986

[30] Foreign Application Priority Data

Dec. 18, 1985 [GB] United Kingdom ..... 8531151

[51] Int. Cl.[4] ..... B65H 54/02; B65H 67/044

[52] U.S. Cl. ..... 242/18 A; 242/18 DD

[58] Field of Search ..... 242/18 A, 18 DD, 18 PW, 242/18 R, 25 A, 25 R

[56] References Cited

U.S. PATENT DOCUMENTS

| | | | |
|---|---|---|---|
| 3,999,715 | 12/1976 | Schippers et al. | 242/18 A |
| 4,106,710 | 8/1978 | Schippers et al. | 242/18 A X |
| 4,166,587 | 9/1979 | Miller | 242/18 A |
| 4,186,890 | 2/1980 | Miller | 242/18 A |
| 4,497,450 | 2/1985 | Schefer et al. | 242/18 A |
| 4,524,918 | 6/1985 | Feusi et al. | 242/18 A |

*Primary Examiner*—Stanley N. Gilreath

*Attorney, Agent, or Firm*—Kenyon & Kenyon

[57] ABSTRACT

The winder is provided with thread divertor guides for both the upper and lower chucks with the angle of diversion not exceeding 120°. The geometry of the winder is such that the respective chucks contact the contact member in separate sub-zones of the winding zone which are spaced apart by a narrow gap. The included angle between the imaginary lines joining the axis of each chuck in its respective rest position to the axis of the chuck when in contact with the contact member lies in a range of from 60° to 175°. The contact member when in the form of a friction drive roll has an external diameter of from 100 to 155 millimeters. When the contact member is in the form of a contact roll with each chuck having an independent drive, the roll may have a diameter in the range of from 60 to 80 millimeters.

33 Claims, 5 Drawing Sheets

WINDER LAYOUT

The present application relates to developments in the art of winding of threads, particularly but not exclusively filaments of synthetic plastics material.

The present invention relates to developments in arrangements disclosed in U.S. patent application Ser. No. 810,679, filed Dec. 18, 1985 and European Patent Application No. 82107022.4 (Publication No. 73930). The U.S. application is referred to herein as the "basic application".

A modification of the geometry disclosed in the basic application has been disclosed in U.S. Pat. No. 4,609,159.

Additional developments which are applicable to the arrangements disclosed in the above-mentioned patent and applications have been disclosed in U.S. Pat. Nos. 4,598,876 and 4,641,793 and U.S. patent application Ser. No. 879,292, filed June 27, 1986.

The disclosure in each of the above copending patent applications is incorporated in the present specification by reference.

As in the case of the basic application, the present invention employs a contact member which is rotatable about a longitudinal axis (contact roller). The contact member receives a travelling thread and has a winding zone for delivering the thread for winding into a thread package. As implied by this statement, therefore, the winder is of the so-called "print" type in which the thread delivered to the winder is brought into contact with a contact roll before being transferred into a package being formed. The contact roll may be arranged to transfer drive to the thread package (a friction drive roll) and/or there may be a separate drive for that package.

The winder comprises at least two chucks upon which thread packages can be formed. The chucks are movable in succession into winding relationship with the contact member. When a winding operation involving one chuck is broken off, a changeover operation is carried out in order to transfer the delivered thread to the other chuck (or another chuck).

A first chuck is rotatable about a longitudinal chuck axis and is movable along a first path from a first rest position spaced from the contact member into a winding position adjacent the contact member. The first chuck is also movable along the first path to return to its rest position. A second chuck is rotatable about a longitudinal chuck axis and is movable along a second path from a second rest position to a winding position adjacent the contact member. The second chuck is also movable along the second path to return to its rest position.

The first and second rest positions are disposed on opposite sides of a plane passing through the axis of the contact member and through the winding zone thereon. The paths converge towards the winding zone.

When a winding operation on one chuck is broken off, an accessible length of thread is created between a thread package on that chuck (the "outgoing chuck") and the contact member. For each changeover operation, that is for changover from the first to the second chuck and vice-versa, a respective guide is provided to divert this accessible length of thread for engagment with the chuck upon which a winding operation is to be started (the "incoming chuck"). Each guide may have an operative position such that the incoming chuck can engage the length of thread when located on a predetermined portion of its respective path adjacent the contact member.

Each chuck may return to its rest position, after breaking off a winding operation, without an intermediate stop on its respective path.

The arrangement is preferably such that the diversion of the thread path caused by the diverter guides (that is, the interference of the guides in the "free thread path") is kept to a low level. This level is conveniently represented by an "angle of diversion" of the thread path, and this angle preferably does not exceed 120 degrees.

The winding zone is preferably located on a concentrated (localized) portion of the periphery of the contact member, and preferably contains a horizontal plane passing through the axis of the contact member. The winding zone is made up of two sub-zones associated respectively with the chucks and spaced from each other by a narrow gap. Preferably, the sub-zones are separated by an arc on the surface of the contact member subtending up to 20° at the longitudinal axis of the contact member.

These and other objects and advantages of the invention will become more apparent from the following detailed description taken alone or in combination wherein:

FIG. 1 schematically illustrates a portion of a known winder;

FIG. 2 schematically illustrates a winding relationship of a winder constructed in accordance with the invention;

Figure 1:
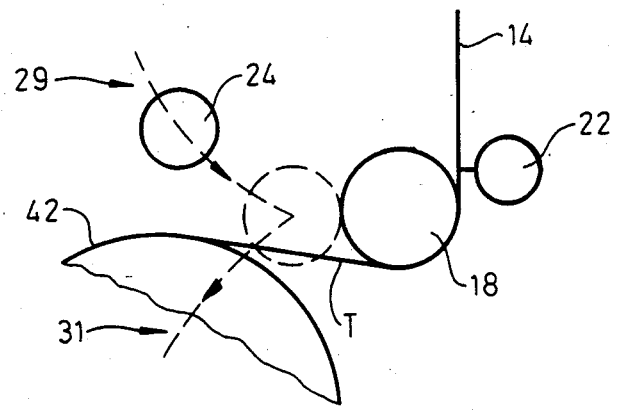

Full details of the machine incorporating the lay-out shown in FIG. 1 can be obtained from the U.S. patent application Ser. No. 810,679, filed Dec. 18, 1985 and will not be repeated here. The machine in question is a filament winder comprising a generally conventional traverse mechanism 22 and a contact member such as a friction roller 18. The machine operates in accordance with the so-called print-friction system, so that a thread 14 entering the winder passes around the friction roller 18 before being transferred therefrom to a thread package building upon one or the other of a pair of chucks, one of which can be seen at 24 in FIG. 1.

The chucks are carried by respective swing arms (not shown), one located above the friction roller 18, and one below the roller 18. Each chuck can therefore be moved from a respective rest position (not shown) into a position in which bobbin tubes (not shown), or thread packages, carried by the chuck are in friction drive contact with the roller 18. The chuck 24 shown in FIG. 1 is the upper chuck of the pair and is shown moving along a path (represented by the locus 29 of movement of the longitudinal chuck axis) from a rest position (above the roller 18) into drive association with the roller (dotted line position in FIG. 1). The lower chuck (not shown) is movable along a respective path (represented by the locus 31 of movement of the longitudinal chuck axis) away from driving association with the roller 18 towards its rest position below the friction roller 18. Part of a completed package 42 carried by the lower chuck at this stage is indicated. A free thread length T extends from the roller 18 to the outgoing package 42 and is accessible for interception by the incoming chuck 24 as described in the basic application.

Figure 2:
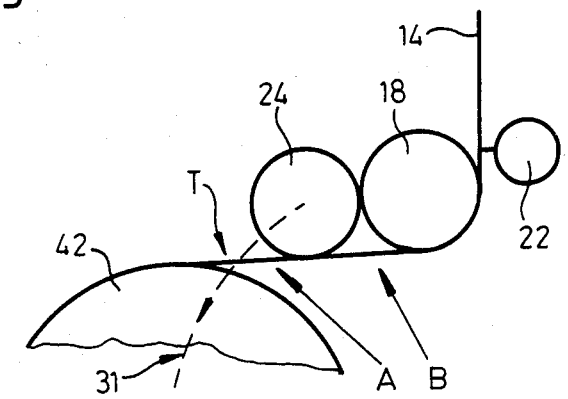
PRIOR ART Fig. 2

Referring to FIG. 2, wherein like reference characters indicate like parts as above, the incoming upper chuck 24 has a significantly greater diameter than the corresponding chuck in FIG. 1. For convenience, the "chuck diameter" will be referred to here, although in fact the relevant dimension is the external diameter of the bobbin tubes carried by the chuck. Unless otherwise indicated, the term "chuck" in this specification includes bobbin tubes carried by the chuck itself.

An increase in the chuck diameter is becoming necessary for a number of reasons. Firstly, there is a tendency to make the chucks longer, and since they are cantilever-mounted (as described in the basic application) it is necessary to provide them with additional strength and stiffness. In this regard, it may be noted that although FIGS. 1 and 2 illustrate only a single thread 14, the winder may form a plurality of packages simultaneously from a corresponding plurality of threads. Since the principles illustrated in this application for a single thread are equally applicable to a plurality of threads, the more complex arrangements will not be specifically described, but it clearly influences the required design of a chuck. In addition, there is a constant tendency towards formation of larger packages requiring stronger chucks.

As the diameter of the chuck 24 increases, it is clearly necessary to move the outgoing package 42 further away from the drive roller 18 in order to provide room for the incoming chuck between them. This not only increases the length of the thread portion T but also reduces a wrap angle of the thread on the roller 18 prior to interception thereof by the chuck 24. That is, as the spacing between the package 42 and the roller 18 is increased to make room for chuck 24, the thread length T is moved steadily further away from the incoming chuck. Eventually, the degree of wrap of thread portion T on the incoming chuck is so small that a thread catching operation can no longer be reliably performed.

The solution to this problem lies in the use of a divertor to distort the thread portion T and thereby increase the degree of wrap of incoming chuck 24. Two possible modes of action of such a divertor are indicated in FIG. 2 at A and B respectively. In one arrangement which will first be described briefly with reference to FIG. 3, thread portion T is diverted by a divertor acting along a line B extending into the space between the friction roller 18 and the incoming chuck 24. In the preferred arrangement, which will subsequently be described with reference to FIG. 4, the divertor has a line of action A passing between the incoming chuck 24 and the outgoing package 42.

Figure 3:
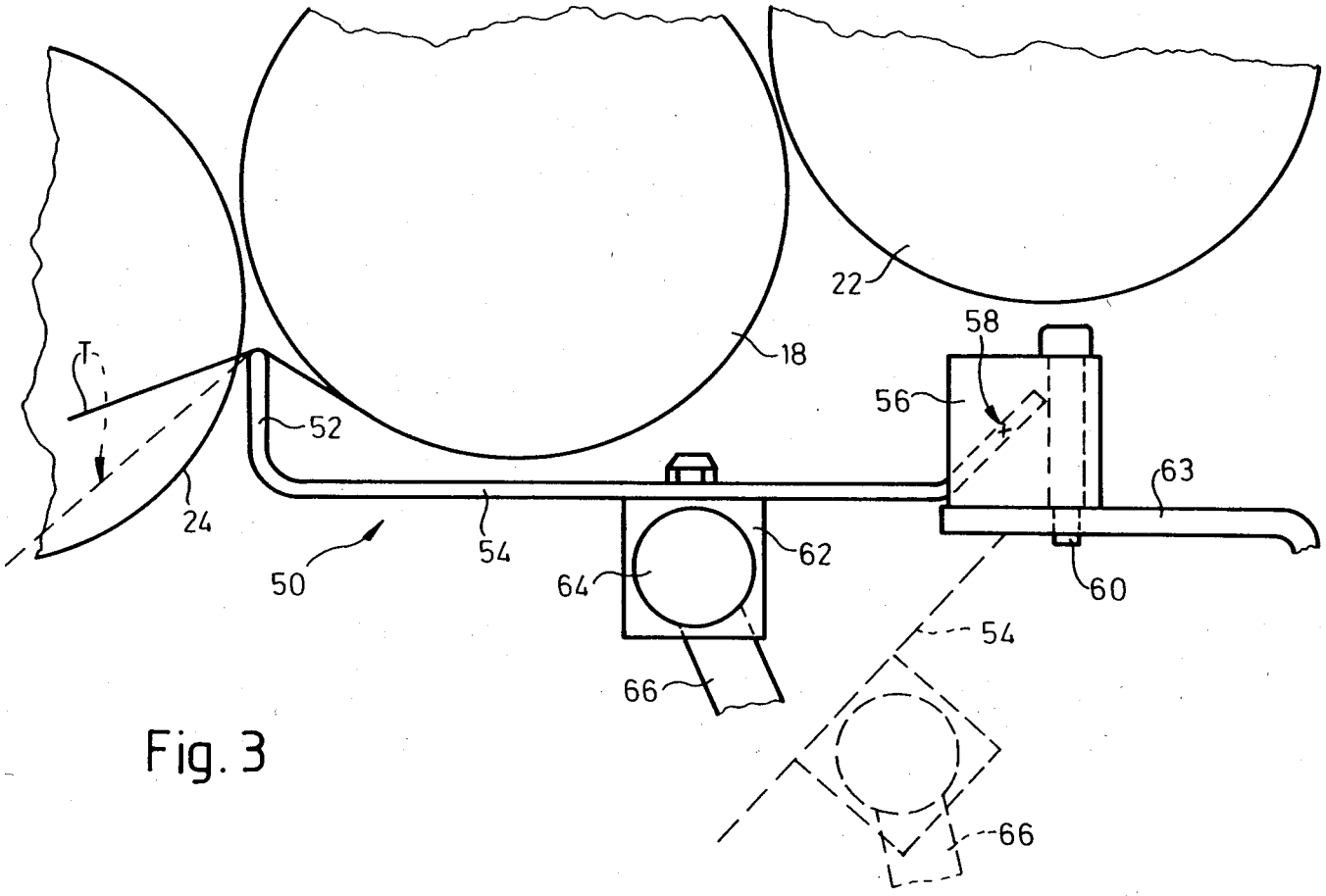
FIG. 3 illustrates a side elevation of a first embodiment of a guide in accordance with the arrangement shown in FIG. 2.

Referring to FIG. 3, the overall arrangement differs slightly from that shown in FIGS. 1 and 2 in a manner which is not immediately apparent from the drawing. In the arrangements shown in FIGS. 1 and 2, it was assumed that the outgoing, lower chuck is temporarily stopped somewhere on its path 31, before reaching its rest position, in order to create the free thread length T. However, as the package 42 is forced to move further along its path 31 in order to make room for chuck 24, this intermediate stop becomes a mere added complication. Accordingly, where a divertor is provided, as described below, the outgoing chuck 26 bearing package 42 is preferably moved back to its rest position without an immediate stop, thereby of course shifting thread portion T still further away from incoming chuck 24. This can be counteracted to some degree by "tilting" the arrangement so that the first point of contact of the chuck 24 with the friction roller 18 lies below a horizontal plane passing through the longitudinal axis of rotation (not shown) of the roller 18. However, there is a limit to the amount of "tilt" which can be used without losing other significant advantages of the machine geometry, and a thread divertor such as that generally indicated at 50 in FIG. 3 eventually becomes essential.

The divertor 50 comprises a thread guiding (contacting) portion 52 and a carrier arm 54. The guide portion 52 extends over the full operational length of the chuck 24 so as to contact all the threads to be wound thereon. The arm 54 may, or may not, extend over the full length of the chuck. At its end remote from the portion 52, the arm 54 is secured to a mounting 56 in a manner which enables the arm 54 to pivot about an axis 58 extending parallel to the longitudinal axis of the friction roller 18. Details of the mounting 56 have been omitted—this can be a conventional form of pivot joint. The mounting 56 is itself fixedly secured, for example by screws 60, to a support element 63 which is mounted by means (not shown) in the frame (not shown) of the machine.

A plate 62 is secured to the underside (as illustrated in FIG. 3) of the arm 54 and forms a pivot joint 64 with one end of a rod 66, the other end of which is secured to a piston (not shown) in a piston and cylinder unit (not shown). The cylinder of the unit is pressurized to move the rod 66 upwardly, the arm 54 is carried from the dotted line position in FIG. 3 to the full line position therein. In the dotted line (inoperative) condition, the divertor assembly 50 is spaced clear of all other moving portions of the winder, in particular the outgoing package 42, and does not interfere with movement of those portions. When the divertor assembly 50 is moved to the full line position, after package 42 has left the way clear, thread guide portion 52 engages the thread length T extending from the friction roll 18 to the outgoing package 42, and pushes this thread portion back upwardly towards the incoming chuck 24. The final (operative) position of assembly 50, as illustrated in full lines of FIG. 3, enables the creation of an adequate angle of wrap of thread portion T on chuck 24 when the latter is in a thread catching position, slightly spaced from roll 18, also as illustrated.

FIG. 3 assumes that the chuck 24 has a recessed thread catching and cutting structure, for example in accordance with U.S. Pat. No. 4,106,711. As indicated by the dotted lines, therefore, the path of thread portion T in engagement with chuck 24 lies radially inwardly of the outer circumference of bobbin tubes carried by the chuck. The degree of diversion of thread 14 by the assembly 50 is sufficient to ensure an adequate wrap angle on the chuck 24 even with such a recessed catching structure. If the thread is required only to engage the outer periphery of the bobbin tubes, for example if a catching slot in such a tube is sufficient to enable catching and severing of the thread, then the wrap angle produced by the assembly 50 will certainly be adequate, and may even be reduced by use of an appropriately adjustable stop (not shown) to limit pivoting of arm 54.

The catching and severing operation itself is generally similar to that described in the basic application and will not be repeated here. When this operation is completed, the assembly 50 is retracted to its inoperative position to avoid interfering with the formation of the new package on the chuck 24. This arrangement is perfectly satisfactory, but for reasons which will be apparent from the subsequent description, the arrangement indicated diagrammatically as in FIG. 2 and illustrated in FIG. 4 is preferred.

Figure 4:
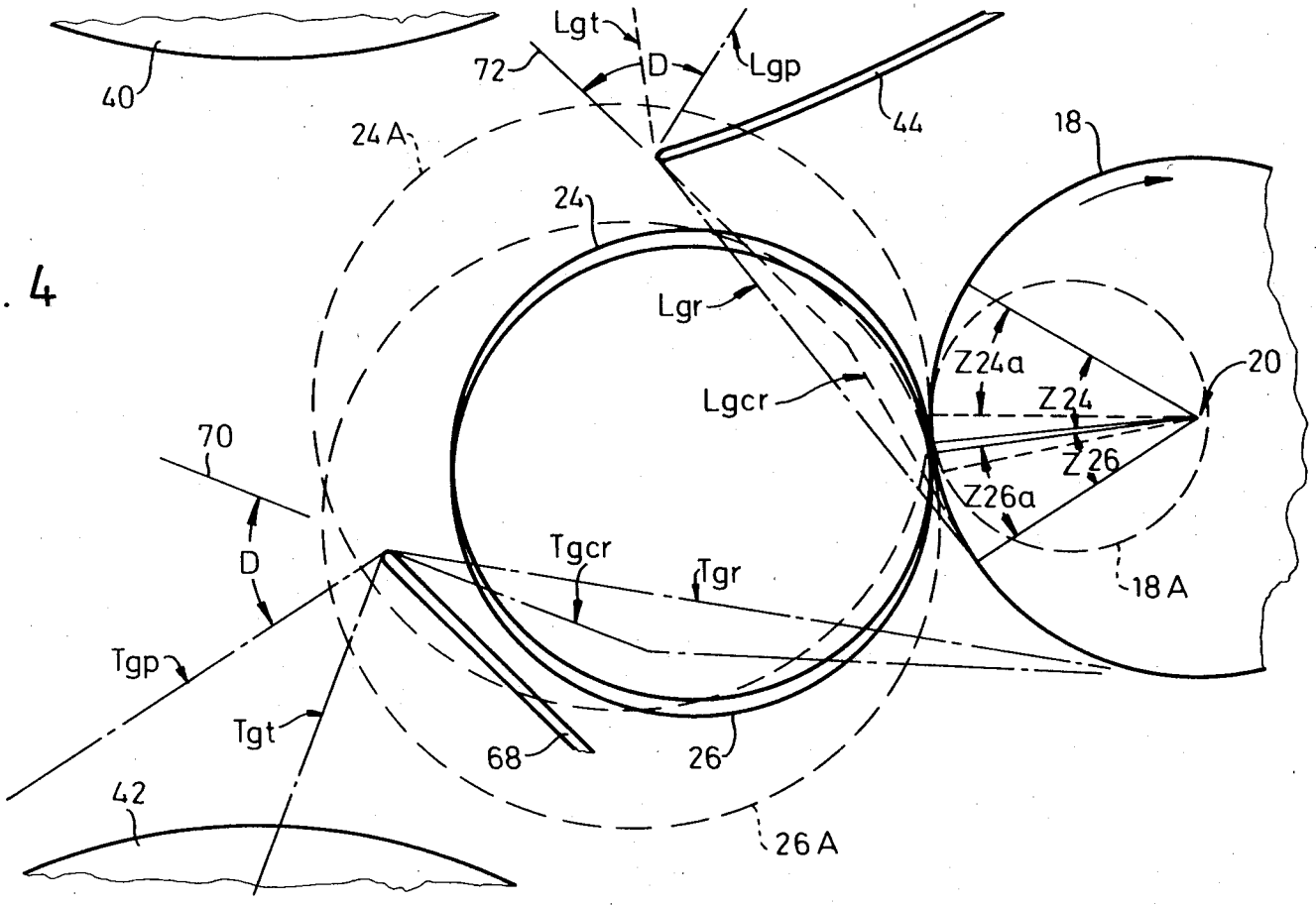
FIG. 4 illustrates a diagrammatic side elevation of a second embodiment of a guide in accordance with the arrangement of FIG. 2.

Referring to FIG. 4, a friction roll 18 similar to that shown in FIGS. 1 and 3 is illustrated in part only. The circle 24 drawn in full lines again indicates the upper chuck in its position of first driving contact with the friction roll 18, that is at the start of a winding operation in the "end winding position" referred to in the basic application. Another circle 26 drawn in full lines represents the lower chuck (not shown in the previous Figures of this application), also illustrated in its position of first driving contact with the friction roll 18. It will be noted, that the axes of the chucks 24, 26 in FIG. 4 cannot travel beyond the intersection of the corresponding loci 29, 31 (FIG. 1) in front of the friction roll 18.

At the upper edge of FIG. 4, on the left hand side, the lowermost portion of a full package 40 carried by the chuck 24 when in its rest position is indicated. At the lower edge of the Figure on the same side, an upper edge portion of a full package 42 carried by the chuck 26 when in its rest position is indicated. As indicated, a divertor guide 44 is used to divert the thread path between the friction roll 18 and the full package 40 during changeover of winding to an incoming empty chuck 26. A divertor guide of this type has been illustated in and described with reference to FIGS. 4 and 13 of the basic application and also in U.S. Pat. No. 4,598,876. The details provided in those prior applications are all relevant to the operation of the guide 44 in FIG. 4 of this application, and in addition certain further details will be described below.

As shown, a divertor guide 68 for diverting the thread path is disposed between the friction roll 18 and an outgoing full package 42 during changeover winding to an incoming empty chuck 24. The function of the guide 68 is generally similar to that of guide portion 52 already described with reference to FIG. 3, but guide 68 contacts the thread portion T between the chuck 24 and the package 42, instead of between the friction roll 18 and the chuck 24 as in the embodiment of FIG. 3. The embodiment of FIG. 4 is preferred because guide 68 can also function as a screening element which helps to prevent a projecting thread tail of package 42 from becoming tangled with parts on the chuck 24.

It will be understood that the parts illustrated in full lines of FIG. 4 are not all present simultaneously in the illustrated conditions. The diagram is being used merely to indicate a number of geometrical features of the winder lay-out. The sequence of movements of the various parts will be described later with reference to FIG. 6. The dotted line portions of FIG. 4 will also be ignored in the immediately following description—they will be referred to later in order to show the effect upon the geometry of variations in the dimensions of certain illustrated parts.

Assume first a changeover from an outgoing full package 42 to an incoming empty chuck 24. Again, for convenience, the chuck 24 will be referred to, although actual contact is made between bobbin tubes carried by the chuck and the friction roll 18. The full line circle indicated at 24 in FIG. 4 actually represents the outer periphery of the bobbin tubes. Assume that the chuck 26 has been returned to its rest position so that the package 42 is in the position partly illustrated in FIG. 4. Guide 68 is in the position illustrated in FIG. 4 and chuck 24 is moving towards roll 18, but has not yet made contact with the thread. The thread length between the friction roll 18 and the package 42 is therefore divided by guide 68 into two portions: the first portion is indicated in dash-dot line at Tgr in FIG. 4 and extends between the guide 68 and the roll 18: the second portion indicated in dash-dot line at Tgp in FIG. 4 extends between the guide 68 and the package 42. For convenience, the thread length between the roll 18 and the package 42 will continue to be referred to herein as the length T; the subscripts "gr", "gp" will be used only where it is important to identify a specific portion of the length of thread.

When the chuck 24 makes contact with the thread length T, the chuck distorts the portion Tgr to a condition indicated in dotted line at Tgcr in FIG. 4. As already described with reference to the embodiment in FIG. 3, the assumption is made that the chuck 24 has a recessed catching and severing structure so that the thread portion Tgcr does not pass around the outer periphery of the bobbin tubes (full line circle 24) but around a recessed surface (not illustrated) within that outer periphery.

The line 70 shown in FIG. 4 is an imaginary line forming an extension of the thread portion Tgcr in its approach to the thread guide 68, i.e. an extension of the common tangent to the thread 68 and the recessed surface in chuck 24 referred to immediately above. The line 70 forms an angle D with the thread portion Tgp and is referred to herein as the angle of "diversion" of the thread portion Tgp from the straight line extension 70 of the thread path Tgcr. Straightforward geometrical principles will also demonstrate that this angle of diversion D is equal to the angle of wrap of the thread portion T on a radiused thread-contacting end of the guide 68. The significance of this angle will be further described later in this specification, when it will be immediately apparent that the magnitude of angle D is dependent upon the degree of interference of the guide 68 in a "free" thread length T between the roll 18 and the package 42.

The thread portion Tgp has been drawn in FIG. 4 to correspond with a package 42 of a specified maximum diameter for which the machine is designed (for example 360 mm). As indicated in the basic application, however, the machine design must allow for changeovers involving packages having diameters less than the designed maximum. The "worst case" involves virtually bare bobbin tubes where, for example, a fault is detected shortly after the start of a winding operation so that a premature changeover must be carried out. In this case, the thread portion extending from the guide 68 to the chuck 26 after the chuck 26 has returned to its rest position might extend, for example, along the dash-dotted line Tgt indicated in FIG. 4. There is a corresponding increase in the angle of diversion D. There is of course no corresponding change in the thread portion Tgcr and hence no change in the position of the line 70.

The thread paths associated with a changeover from an outgoing full package 40 to an incoming lower chuck 26 have also been illustrated in FIG. 4. They will be referred to relatively briefly, since it is believed that the arrangement will be generally clear from analogy with the immediately preceding description. Thus, assume that a thread length L is created between the friction roll 18 and an outgoing package 40 by return of the upper chuck 24 to its rest position. Assume further that package 14 has the maximum designed diameter. Then, prior to contact of thread length L with an incoming chuck 26, the thread length will be divided by guide 44 into an "upstream" portion Lgr between the guide 44 and the roll 18 and a "downstream" portion Lgp between guide 44 and package 40. After contact between the chuck 26 and the thread length L, the latter will be distorted to the position Lgcr between guide 44 and roll 18. Line 72 is the straight line extension of thread path Lgcr at guide 44 similar to the extension 70 previously described in connection with guide 68. The angle of diversion (and hence the angle of wrap) at guide 44 is again indicated with the letter D; there is no necessary relationship between the magnitudes of the angles of diversion at the guides 44 and 68—since the general principles to be described below apply equally to both angles, however, they have not been distinguished in the present drawings.

Assume now that a changeover must be carried out with virtually bare bobbin tubes on the upper chuck 24. Then, the downstream thread portion between guide 44 and the chuck 24 will lie along the line Lgt at the time of the changeover. As before, there will be no change in the upstream thread portion. Of note, the "worst case" (largest designed angle of diversion D) at the upper guide 44 is not associated with a changeover involving bare bobbin tubes (as in the case of the guide 68) but with a changeover involving the largest designed packages, i.e. the angle of diversion D at the upper guide 44 is lower for the thread path Lgt than for the thread path Lgp.

As indicated above, the angle of diversion D (whether at the upper guide 44 or the lower guide 68) is a measure of the interference of the relevant guide in the associated thread path. The maximum acceptable degree of interference is strongly dependent on the surrounding circumstances, in particular upon the structure of the guide, the speed of delivery of the thread to the winder and the structure of the thread itself. For simplicity, it is preferred to use a relatively simple and robust thread contacting guide having a radiused edge in the thread contacting region. This implies, however, that the velocity of the thread relative to the interfering guide is directly related to the thread delivery speed. Under these circumstances, a coarse, elastic thread delivered at low speed can tolerate much more interference from the guides 44, 68 than a fine, relatively inelastic thread delivered at high speed. In this context, a relatively low thread delivery speed is in the range up to 3000 m/min. (linear speed along the thread path) and a relatively high speed is in the region of 4500 m/min. and above. A coarse thread has a titer in the region 300 decitex to 4000 decitex, and a fine thread has a titer in the range 15 decitex to 300 decitex. A relatively elastic thread has an elongation in the range 30% to 40%, and a relatively inelastic thread has an elongation in the range 15% to 20%. The machine must, of course, be capable of handling conditions in between these borderline ranges.

In accordance with the one feature of the present invention, it is suggested that the angle of diversion D should on no account exceed 120 degrees. It is emphasised, however, that the winder geometry is preferably so laid out that the maximum angle of diversion D lies substantially below the value of 120 degrees.

In practice, a maximum of 100 degrees is recommended. Furthermore, it is recommended that an angle of diversion of 90 degrees or less should be used during a changeover involving a package of maximum diameter for which the machine is designed. In view of the remarks made above regarding "worst case" conditions, this recommendation is clearly most relevant to a changeover involving a full package on the upper chuck 24 in FIG. 4; assuming that the other recommendations are followed, there should be no difficulty in maintaining a relatively low angle of diversion during a changeover involving the maximum diameter package on the lower chuck 26.

Some factors affecting the possibility of complying with the above recommendations in varying circumstances will now be described with reference to FIG. 5. Of note, FIG. 5 does not correspond precisely with the geometry of FIG. 4 but is sufficiently accurate to illustrate the factors involved in the relevant considerations.

Figure 5:
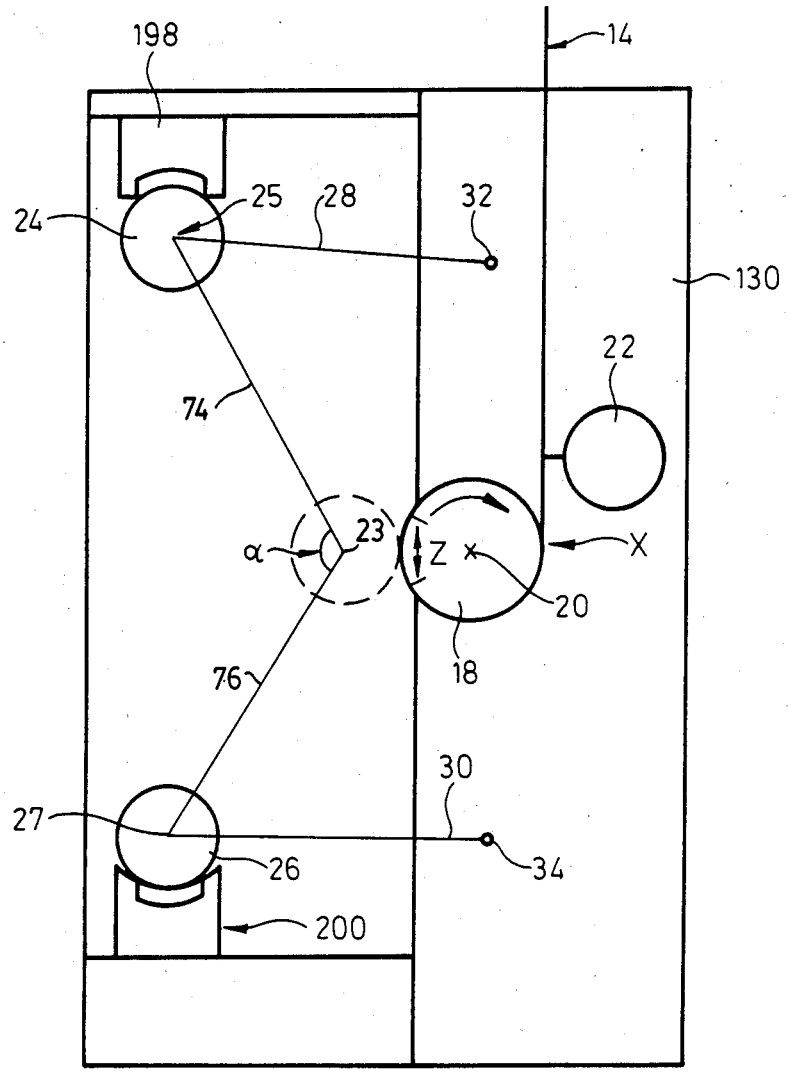
FIG. 5 illustrates a side view of a winder constructed in accordance with the invention.

Referring to FIG. 5, the friction roll 18 is mounted on a longitudinal axis 20 while respective swing arms 28, 30 carry the chucks 24, 26 to pivot about pivot axes 32, 34. The chucks 24, 26 also rotate about respective axes of rotation 25, 27. Suitable stationary structures 198, 200 establish the rest positions of the chucks 24, 26 in the winder while a support plate 130 supports the roll 18 and traverse mechanism 22 in the machine frame.

For convenience of illustration in FIG. 5, the separation of the positions of first contact of the chucks 24, 26 with the friction roll 18 has been ignored, and a common position of first contact (indicated in dotted lines) is assumed. The "central axis" of this common position (which in FIG. 5 is indicated at 23) is joined by an imaginary line 74 to the axis 25 of chuck 24 in its rest position and by an imaginary line 76 to the axis 27 of the chuck 26 in its rest position. The angle $\alpha$ defined between the lines 74 and 76 is referred to hereinafter as the "included angle". A corresponding included angle can be defined regardless of whether the chucks have a common position of first contact with roll 18. It is merely necessary to create two imaginary lines, the first joining the axis of the upper chuck 24 in its rest position with the axis of the same chuck in its position of first contact with the roll 18, and the second joining the axis of the lower chuck 26 in its rest position with the axis of same chuck in its position of first contact. The point of intersection 23 of these imaginary lines will not then coincide with either of the chuck axes in the first contact positions, but the relevant principles are unaffected by this.

The following discussion of the angle $\alpha$ assumes the preferred arrangement of the machine geometry in accordance with which a "winding zone" indicated at z in FIG. 5 can be defined such that a horizontal plane including the axis 20 passes through this winding zone z. The winding zone z is a zone in which a transfer of the thread 14 from the friction roll 18 into a package can occur during a normal winding operation. In accordance with the print-friction system, thread 14 first contacts roll 18 near the point indicated at x in FIG. 5, and roller 18 rotates in the (clockwise) direction indicated by the arrow in FIG. 5 to carry the thread from the contact point x into the winding zone z.

In order to simplify the discussion, it is also assumed that in any machine geometry under consideration, the rest positions of the chucks 24, 26 are located as close as possible to the friction roll 18 (minimum movement into the winding position) for a given maximum designed package diameter, subject to the need to avoid interference between a package on a chuck in one rest position while a package is building on a chuck in a winding position. As indicated in the basic application, this latter requirement is in itself subject to assumptions regarding the frequency of doffing (removal of completed packages). If the full packages will definitely be removed quickly after the start of a new winding operation, then the "non-interference condition" is easier to fulfill than if the machine must be designed to carry two maximum diameter packages simultaneously. By way of example, the latter type of machine is assumed.

Variation of the included angle $\alpha$, under the above assumptions, will have a number of effects upon the machine layout. From consideration of FIG. 5 it will be clear that reduction of angle gives $\alpha$ a broader, lower machine and increasing this angle gives a narrower, higher machine. In general, machine breadth carries a greater premium than machine height, and there will be a tendency to increase angle $\alpha$ as far as possible. It is believed that an angle $\alpha$ below 60° is unlikely to be of commercial interest; this corresponds to a machine almost 1 meter wide with full packages of 360 mm diameter.

Consideration of FIG. 5 would also show that there is a limit to the increase in angle $\alpha$ which can be obtained by moving the rest position of chuck 24 to the right as viewed in the Figure. Sooner or later, a full package carried by the chuck will begin to interfere with machine structure normally provided (but not shown in FIG. 5) above friction roll 18, and eventually even with the line of the thread 14 as it approaches friction roll 18. Although the same considerations do not apply in relation to the lower chuck 26, there would clearly be no point in moving the imaginary line 76 beyond the vertical, since no improvement in the utilisation of the enclosed space can be obtained by that means. Accordingly, it is believed that the maximum practical value of the angle $\alpha$ lies in the range 170°–175°.

In addition to its effect upon the utilisation of space within an envelope of given dimensions, however, the angle $\alpha$ also affects the angle of diversion D illustrated in FIG. 4. Thus, assuming that an outgoing chuck 24 or 26 is returned to its rest position for a changeover operation, then for a package of given diameter an increase in the angle $\alpha$ is associated with an increase in the angle of diversion D during a changeover involving that package. This is particularly important in relation to the lower guide 68, because the worst case condition is associated in that instance with the bare bobbin tubes rather than with the full package as in the case of guide 44. In the case of the upper guide 44, an increase in angle $\alpha$ has a much reduced effect upon the worst case angle of diversion D.

In view of all these factors, it is recommended that the angle $\alpha$ should lie in the range 140°±20°, and preferably even within the range 130°–⅛°. It is believed that this recommended range is substantially insensitive to significant changes in maximum designed package diameter. The reason is that such changes in package diameter tend to be associated with corresponding changes in the external diameters of the chucks and the bobbin tubes which carry the packages. Referring to FIG. 5, a large change in package diameter may be associated with a shift in the lines 74, 76 to the left away from roll 18, but those lines in the heavier (larger) machine may be substantially parallel to the corresponding lines in the lighter (smaller) machine.

In any event, the angle is preferably chosen so that in the rest positions the axes of the chucks lie in a vertical plane parallel to the axis of the friction roll. This makes it easier to arrange for doffing of the machine.

Effects of design changes

Reference back to FIG. 4 will show that the recommended machine geometry can be applied despite very significant changes in parameters such as chuck and friction roll diameter. Taking first the full line illustration in that Figure, the winding zone Z referrred to in the description of FIG. 5 is seen to be made up of two sub-zones Z24 and Z26 associated respectively with the upper and the lower chucks 24, 26 with a narrow gap between the sub-zones Z24, Z26.

Assume now that the friction roll diameter is maintained (full line illustration) but the chuck (bobbin tube) diameter is increased so that upper chuck 24 first makes contact with the friction roll in the position indicated with dotted lines at 24A and the lower chuck first makes drive contact with the friction roll at the position indicated in dotted lines at 26A. This gives a corresponding increase in the gap between the sub-zone on friction roll 18, so that the new winding sub-zone for the upper chuck is indicated at *Z24a* and the sub-zone for the lower chuck is indicated at *Z26a*. It will be noted that there is a change only in the initial positions of contact of the respective chucks with friction roll 18, and not in the final positions of contact of the fully packages carried by those chucks; the latter positions are not affected by the chuck diameter but only by the diameters of the largest packages carried by those chucks. Consideration of FIG. 4 will indicate that the larger chuck diameter causes little or no change in the thread path conditions during changeover from an outgoing package 40 on the upper chuck to an incoming lower chuck 26A. A minor change to the positioning of the lower guide 68 is required to avoid interference between this guide and an incoming upper chuck 24A during a changeover involving an outgoing full package 42. However, thread portion Tgt after the shift will be substantially parallel to the corresponding thread portion before the shift, because the movement of guide 68 is "compensated" by the increase in diameter of the chuck in its rest position (not illustrated). Accordingly, there is no significant change in the worst case conditions at guide 68. By way of example only, the variation in chuck size and corresponding machine geometry illustrated in FIG. 4 is applicable at least to a change from a smaller chuck of external diameter 94 mm (bobbin tube external diameter 105 mm) to larger chucks of external diameter 125 mm (bobbin tube external diameter 137 mm).

To this stage, it has been assumed that the friction roll 18 will act as a drive roll transferring drive moment to the chucks and packages in contact therewith. This is not essential, however, since it is possible to incorporate drive motors in the chuck structure and/or its mounting, thus converting the machine to the so-called "spindle driven" type. For reasons explained in copending European Patent Application No. 83 102 495.5 (published under the No. 94483) a contact roll may still be desirable even in a spindle driven winder, and may function as a print roll. Such a roll is not, however, required to transmit significant amounts of drive power to the chucks and packages.

In all forms of print winding system, it is preferable to reduce the diameter of the contact roll as far as reasonably possible. A smaller roll diameter gives an improved chance of maintaining stability of the thread position on the roll after it has been laid thereon at the position x (FIG. 5) and during its travel into the winding zone z. On the other hand, where the roll 18 is also acting as a drive roll, it is necessary to maintain a minimum contact pressure between the forming package and the drive roll in order to ensure adequate transference of drive moment. If the friction roll diameter is reduced unduly in such circumstances, severe distortion of the relatively soft package can occur as the package diameter increases. In general it is believed undesirable to use friction roll diameters in excess of 150 mm. Preferably, in a friction driven winder, the diameter of the friction roll lies in the range 105 mm to 125 mm. The roll 18 illustrated in full lines in FIG. 4 can be assumed to have a diameter within this range. Where the winder is not friction driven, however, the contact pressure between the contact roll and the package can be substantially reduced, and the contact roll diameter can then also be reduced, for example to a value in the range 60–80 mm. The diameter of the contact roll indicated in dotted lines at 18A in FIG. 4 can be assumed to lie in this range. In this specification, the term "contact roller" ("contact roll") is used broadly to cover both friction drive rolls and rolls which do not transport drive power.

In order to avoid further complicating FIG. 4, the relevant lines defining the winding zones and the thread paths for the smaller contact roller have not been indicated. It can readily be shown, however, that for given package and chuck dimensions, even this substantial change in the roll diameter has only a marginal effect upon the overall geometry. Thus, for the smaller chucks (bobbin tube diameter 105 mm) shown in FIG. 4, winding packages of 360 mm maximum diameter, a change in contact roll diameter from 116 mm to 60 mm causes a change in the total angle enclosed at the roll axis 20 by the winding zone z (from outer limit to outer limit, i.e. including the small gap between the sub-winding zones) from 63° for the larger roll to 69° for the smaller roll. The reduction in diameter of the roll causes an increase in the angular dimension of the gap from about 2° to about 4°. As can be readily appreciated from examination of FIG. 4, therefore, this significant change in contact roll diameter has a very little effect upon the positions of the chucks in which initial contact with the roll is made. Further consideration of FIG. 4 will show that the reduction in contact roll diameter has only a marginal effect upon the path of thread portion L between the roll and upper guide 44; if necessary, a very slight injustment in the position of the guide will enable achievement of adequate wrap angle on an incoming chuck 26.

The reduction in contact roll diameter actually tends to cause an increase in wrap angle on an incoming chuck 24 for a given position of the lower guide 68. Accordingly, that guide could be adjusted to give less interference with the thread length T extending to the outgoing package 42, with a corresponding improvement of the conditions at the contact zone between the thread and the guide 68.

As previously indicated, for a given contact roll diameter, the outer limits of the winding zone z are not dependent upon chuck diameter but upon maximum designed package diameter. For the case of the 116 mm roll referred to above, a change in maximum package diameter from 360 mm to 450 mm causes a change in the total angular extent of the winding zone (including the gap) of approximately 20°. It is believed, therefore, that a maximum angular extent of the winding zone (including any gap therein) of 100° will prove adequate even for very large packages and small contact rolls.

Details of the geometry of the thread paths over the thread divertor guide have been discussed in detail with reference to the embodiment of FIG. 4. Exactly the same considerations apply to the embodiment of FIG. 3. In that case, the angle of diversion (not illustrated in FIG. 3) is not variable in dependence upon the diameter of the outgoing package 42, but is given by the (fixed) diameter of the thread receiving surface in the catching and severing structure of the incoming chuck 24. This is a slightly less favourable arrangement, because the ("normal") changeover with a full package diameter in FIG. 4 is associated with a relatively low angle of diversion. However, no difficulty will be found in maintaining the fixed angle of diversion in FIG. 3 within the limits already stated above.

Operating sequence

Figure 6:
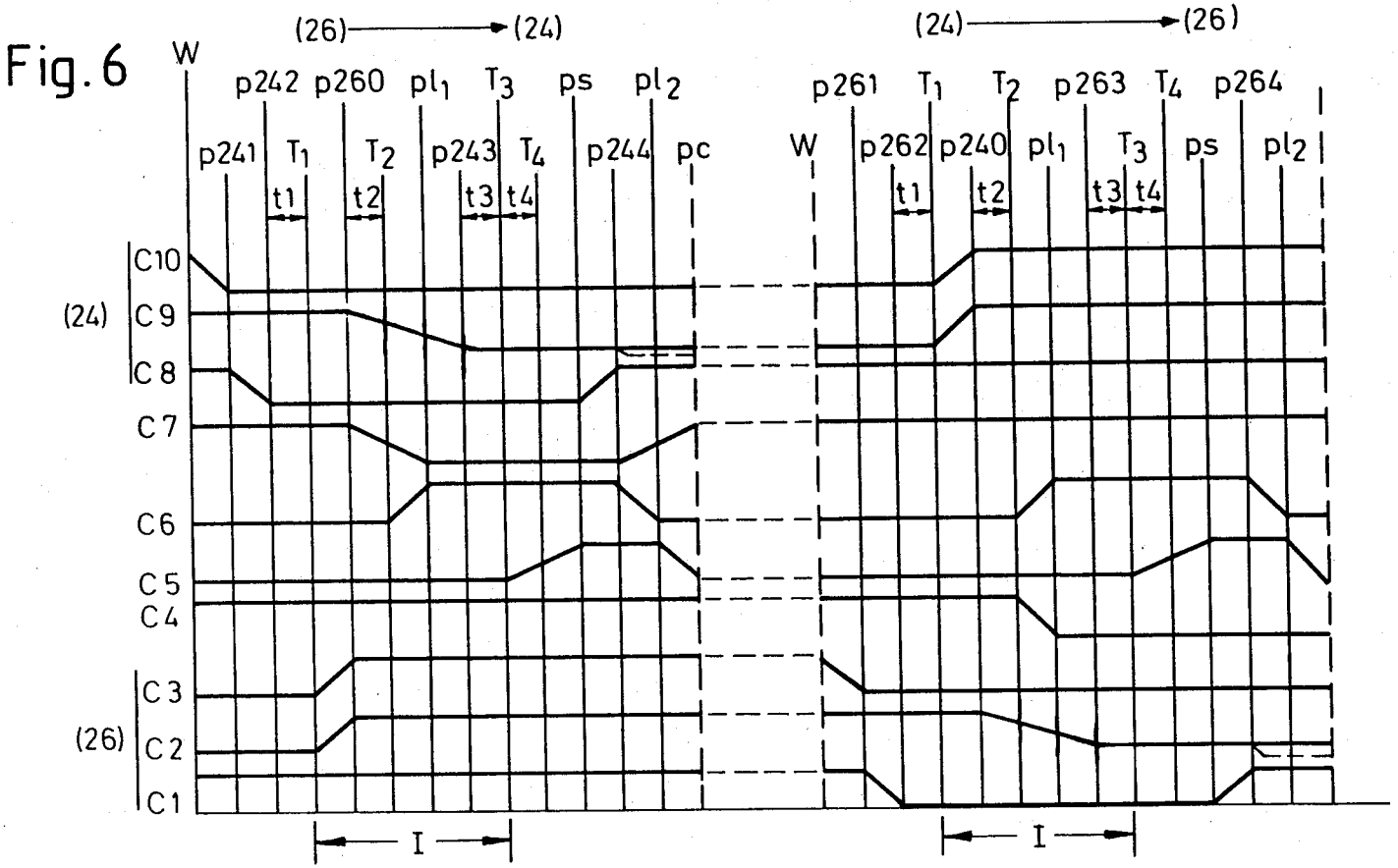
FIG. 6 illustrates a sequence diagram for use in explanation of the embodiment shown in FIG. 4.

Finally, the timing (sequencing) of movement of the various elements will be described with reference to the diagram in FIG. 6 in which time is represented on the horizontal axis. The diagram shows traces representing the respective conditions of ten separate piston and cylinder units (moving devices) for causing movement of various elements of the machine as will be described below. In FIG. 6 these units are labeled C1 to C10 respectively starting from the bottom of the vertical axis, but the arrangement of the traces in the diagram is concerned only with convenience of presentation and has no significance in relation to the operation of the machine.

Starting from the bottom of the diagram and the moving upwards, unit C1 is arranged to move lower chuck 26 axially of its own length for a purpose fully described in the basic application. Unit C2 causes movement of the chuck 26 into contact with friction roll 18 and creates a desired contact pressure between those elements. Unit C3 shifts lower chuck 26 from its rest position into an acceleration position, adjacent the rest position considered along the path of movement of the chuck; as described in the basic application, in this intermediate position on its path the chuck can be accelerated to a desired speed before been moved into contact with the friction roll by unit C2.

Unit C4 moves the upper guide 44 between its operating position (FIG. 4) and the withdrawn position above the friction roll 18 (illustrated in FIG. 13 of the basic application). Unit C5 operates a thread guide to shift the thread axially of the incoming chuck during a changeover operation to move the thread into a catching device on the chuck (a suitable arrangement is shown in U.S. Pat. No. 3,920,193, but a now-preferred arrangement is shown in U.S. patent application No. 723,981). Unit C6 operates a member which temporarily lifts the thread out of the thread guide of traverse mechanism 22 for a purpose fully described in the basic application. Unit C7 moves the lower guide 68 between its operative position (FIG. 4) and a non-illustrated withdrawn position in which it will not interfere with any moving parts of the winder. Units C8, C9 and C10 are equivalent to Units C1, C2 and C3 respectively, but operate upon the upper chuck 24 instead of upon the lower chuck 26.

Two sequences of operations are represented in FIG. 6. In the first sequence, from the left hand vertical axis to the first dotted vertical line, a changeover is effected from winding on lower chuck 26 to winding on upper chuck 24. In the second sequence, between the second and third vertical dotted lines, the reverse changeover is illustrated. Between the first and second vertical dotted lines a normal winding operation is assumed to be in effect, and there is no change in the conditions of the traces in that period. A horizontal line in a trace indicates steady conditions; a change is represented by an inclined trace.

Each illustrated sequence is controlled by a combination of position responsive and timing devices as will now be described. In the time period leading up to the first illustrated changeover (not illustrated, to the left of the vertical axis in FIG. 6) a normal winding operation is assumed to be proceeding with a package 42 on the lower chuck 26 in contact with the friction roll 18. The letter w on the vertical axis indicates that at this instant a signal is emitted to represent the completion of the winding operation on chuck 26 and the introduction of the changeover operation. As a first step, unit C10 is operated to lower the upper chuck 24 from its rest position into its acceleration position. Arrival of chuck 24 in the latter position is registered by a position sensor indicated by reference P 241. Upon its arrival in the acceleration position, chuck 24 is immediately retracted axially by operation of unit C8, Retraction of the upper chuck is registered by position sensor P 242. This is followed by elapse of a short time period t 1 during which the chuck is accelerated to the desired speed referred to above. When a suitable timer T 1 indicates the expiry of this period, units C2 and C3 are operated to break off the winding operation on chuck 26, which returns immediately to its rest position. Arrival of chuck 26 in the latter position is registered by a position sensor P 260.

Unit C9 is now operated to start movement of upper chuck 24 from its accelerating position towards its position of first contact with friction roll 18. At the same instant, unit C7 is operated to initiate movement of the lower guide 68 from its withdrawn position (not illustrated) into its operative position (FIG. 4). After the elapse of a predetermined time t2, and while movement of the guide 68 and the chuck 24 towards their new positions is still continuing, unit C6 is operated to lift the thread out of the traverse mechanism. Completion of the lift-out step is registered by a position sensor Pl 1. The thread, which is still being taken up by the lower chuck 26, is no longer traversed axially to form cross-windings, but is permitted to form parallel windings at a specific location on the outgoing package. The length of thread represented by the localised, parallel windings can be adjusted by setting the adjustable timer T2.

Movement of chuck 24 along its path 29 (FIGS. 1 and 2) continues after completion of movement of divertor guide 68 (unit C7) and of the non-illustrated thread lifting mechanism (unit C6). A predetermined approach position, in which unit C9 has almost, but not quite, completed its operating stroke, is registered by position sensor P 243. This triggers a timing device represented in FIG. 6 by T3, and unit C9 completes its stroke during the set period t 3 determined by this timer. The position of chuck 24 relative to friction roll 18 upon completion of the stroke of unit C9 is adjusted in dependence upon the designed operating conditions. If the chuck is to be rotated with an "overspeed" during the changeover operation (that is, if the linear speed at the periphery of the bobbin tube is to be higher than the linear speed at the periphery of the friction roll), then a small spacing is left between the chuck and the friction roll even at completion of the stroke of unit C9. If the linear speed of the chuck is equal to that of the friction roll during changeover, then they can be brought into engagement at completion of the stroke of unit C9.

The stages of the changeover operation up to the runout of timer T3 may be considered in combination as a preparation phase leading up to the final phase which is initiated by the expiry of t3. At the completion of the preliminary or preparation phase, the thread is in the condition illustrated in FIG. 4 by the thread path TgcrTgt and is running steadily onto the completed package 42 at a specific axial location to form parallel windings thereon. This axial location is such that the thread portion Tgcr engages a receiving surface on chuck 24 adjacent a catching and severing structure (not shown) recessed therein. In FIG. 4, in view of the scale of the drawing, no attempt has been made to illustrates the small gap which, as described above, may be present between the chuck and roll 18.

When timer T3 runs out it initiates operation of unit C5 to shift thread portion Tgcr (FIG. 4) axially of chuck 24 into the catching and severing structure referred to above. Completion of operation of unit C5 is registered by a position sensor ps. The timer T4 which is triggered by expiry of timer T3 and which itself runs out before completion of operation of unit C5, enables control of the axial shifting operation in accordance with the system described in copending U.S. patent application Ser. No. 723,981.

When position sensor ps registers the completion of operation of unit C5, the actual transfer of thread from package 42 to chuck 24 has been completed, i.e. the thread has been severed between chuck 24 and package 42 and the continuously delivered thread has been secured to and is winding on chuck 24. Unit C8 is now operated to move the chuck longitudinally into its normal winding condition. Furthermore, if a small gap was left between the chuck and roll 18 during the transfer operation, this gap is now rapidly closed as indicated by the dotted line variant of the trace associated with unit C9.

When a position sensor P 244 registers the completion of operation of unit C8, so that chuck 24 is in its normal winding position, unit C6 is operated to return the thread to the normal traverse mechanism 22, and completion of this operation is registered by a position sensor pl 2. Return of the thread to the normal traverse mechanism removes it from the region of influence of the axial shifting mechanism operated by unit C5. That unit can therefore now be operated to return the mechanism to its original condition, ready for initiation of the next changeover operation. The return of unit C5 to its initial condition is registered by the sensor pc and indicates the completion of the actual changeover operation. Normal winding of thread has in any event begun as soon as the thread is returned to the traverse mechanism.

Additional attention will now be paid to the preliminary stages commencing with the return of chuck 26 to its rest position (indicated by sensor p 260) and terminating with run-out of timer T3. The conditions to be achieved by the end of the latter stage are important for successful transfer of thread to the incoming chuck. An important factor in the achievement of the necessary conditions is the elapse of sufficient time after completion of operation of unit C6 (i.e. lifting of thread out of the traverse mechanism) to enable the thread to return to stable (non-vibrating) running conditions before commencement of axial shifting of the thread by unit C5. The insertion of guide 68 into the thread path between roll 18 and package 42 assists in damping these vibrations, and it is therefore useful to have guide 68 in position at about the same time as the thread is released from the traverse mechanism as illustrated in FIG. 6. As also shown in that Figure, the steps are preferably completed before unit C9 has finished its stroke, so that the axial shifting of the thread can be commenced as soon as possible after the chuck has reached the required position. However, this precise sequence of operation is not essential. Thread guide 68 could be inserted in the thread path at any time up to commencement of axial shifting at the expiry of time t3, that is the completion of operation of unit C7 in FIG. 6 may be arranged to occur at any time before the expiry of time period t3.

In view of the detailed explanation of the first illustrated changeover operation, it is believed that the second changeover (from the upper to the lower chuck) will be clear from a relatively brief description. Following issue of the signal W indicating completion of a winding operation (now on the upper chuck 24), unit C3 is operated to move chuck 26 to its accelerating position and its arrival there is registered by sensor p261. Unit C1 is then operated to withdraw chuck 26, and completion of this step is indicated by sensor p262. After run-out of the acceleration timer T1, units C9 and C10 are operated to return chuck 24 to its rest position, and arrival there is registered by sensor p240. This is followed by operation of unit C2 in order to move chuck 26 towards contact with roller 18.

After run-out of timer T2, unit C6 is operated once again to lift the thread out of the thread guide of traverse mechanism 22, and completion of this step is indicated by sensor pl 1. The approach position of chuck 26, in which it lies near but not in contact with roll 18, is registered by sensor p263. This initiates timer T3, and at the expiry of the relevant time period, unit C5 is operated once again in order to shift the thread axially of chuck 26 into the catching and severing device thereon.

In the meantime, guide 44 has been moved from its non-illustrated, inoperative position into the operative position illustrated in FIG. 4. This is performed by unit C4 represented in FIG. 6. As indicated there, operation of unit C4 is commenced at the expiry of time t2 and is completed at about the time the thread is lifted clear of the traverse mechanism. As indicated above for guide 68, however, movement of the divertor guide 44 to its operative position can be delayed relative to the timing shown in FIG. 6 provided this operation is complete by the expiry of time period t3. At the expiry of that period, the thread path is as represented in FIG. 4 by the portions Lgcr and Lgp.

The final phase of the second changeover is completely analagous to the final phase of the first changeover and will not be described in any detail. Sensor p264 shown in FIG. 6 is a sensor registering return of chuck 26 to its extended (normal winding) position. As previously described for guide 68, guide 44 is assumed to be withdrawn as soon as its guiding function is completed and this has been indicated in the last-illustrated stage of the trace for unit C4 in FIG. 6. In accordance with U.S. Pat. No. 4,598,876; however, guide 44 may be left in its operative position throughout a winding operation on the lower chuck 26, for a purpose fully described in therein. The relevant timing arrangements for this purpose will be described in the separate application which will also describe the screening functions of guide 68.

For convenience of illustration and description, the time periods t2 and t3 have been assumed equal for the two illustrated changeover operations. This is not essential. The relevant timers can be settable and can be adapted to the movement patterns of the relevant chucks. It should also be mentioned that FIG. 6 is not intended to represent a precise timing diagram but only the sequence of the various steps referred to. In FIG. 6, the steps are illustrated as though they were of equal duration, whereas this will not be the case in practice. Furthermore, additional steps, not directly relevant to the present invention, can be built into the sequence, for example monitoring of the conditions of non-illustrated protective screens within the winder.

Since the lower chuck 26 is now returned immediately to its rest position after breaking-off a winding operation, an individual short-stroke unit (for chuck 24-unit C10 and for chuck 26-unit C3, FIG. 6) can be provided to move the chuck from its rest position into its accelerating position and a separate unit with a much longer stroke (for chuck 24-unit C9 and for chuck 26-unit C2, FIG. 6) can be provided for movement into the winding position and for maintaining desired contact pressure between the package and the friction roll.

As described for the upper divertor in the basic application, the divertor guides (44, 68) can be arranged to move axially of the chuck and to carry the threads along in sychronism with the axial movement caused by the unit C5 referred to above. However, it is preferred to avoid this complication where the movement of unit C5 is alone adequate to move the thread (s) into the catching device on the chuck.

The invention is not limited to a simple radiused contacting edge on the divertor guides 44, 68. Any means of reducing frictional drag on the thread will reduce the undesirable effects of interference in the thread path. For example, an air cushion might be created at the thread contacting zone on each guide, or the thread contacting zone might be provided on a rotatable element (preferably driven into rotation during a changeover). Again, however, it is preferred to avoid such complications where the effects of interference with the thread path are tolerable.

The worst possible effect of such interference is a thread break. Another undesirable effect, which can rapidly lead to a break, is a collapse in thread tension upstream from the guide so that control of the thread is lost. Less serious but undesirable effects are breakage of individual filaments (fibrils) in the thread and alteration of thread characteristics (e.g. bulk).

The winder geometry now proposed has a number of advantages. Firstly, the movements required of the thread diverting guides (44, 68) are relatively short. In no case is a divertor guide required to travel across the horizontal plane containing the axis of roll 18. This brings several associated advantages, one of which (relatively little interference with the thread path) has already been explained in the course of the description. A second associated advantage is that the length of the thread "tail" produced on each package by severing of the thread between the outgoing package and the incoming chuck is kept relatively small and there is thus relatively little chance of entangling of the thread tails with parts of the winder. A third advantage is that there is no need to create "slack" in the delivered thread in order to accommodate diversion by the guides. A fourth advantage is that the required movements can be carried out relatively quickly; this advantage will be dealt with in further detail below.

Referring once again to FIG. 6, it will be readily appreciated that the time interval I (indicated on the horizontal axis) should be kept as short as reasonably possible. At the start of this interval, the preceding normal winding operation is broken off, and the rotational speed of the outgoing package begins to decline. After the run-out of timer T2, the traverse motion ceases, which is equivalent to a stepform reduction of the take-up speed for the delivered thread. In a system dependent upon drive from the friction roller 18, therefore, tension in the thread line leading to the winder will begin to fall away at the start of the interval I, and the fall-off will become steadily worse the longer this interval lasts.

The immediately preceding remarks do not apply with the same force to a spindle-driven system, or to a winder in which an auxiliary device is provided to maintain drive of the outgoing chuck after the winding operation is broken off. Such auxiliary devices are known, for example, from the following patent specifications: U.S. Pat. Nos. 4,033,519; 3,921,923; DE No. 2511764 and European Published Application No. 128101.

Even where the system is not dependent upon drive from the friction roller, however, a longer period I is undesirable. So long as the thread is still being traversed, cross windings are being formed, but without contact between the outgoing package and the friction roller. As soon as the traverse ceases, parallel windings are being formed and there is a limit to the acceptable dimensions of the ridge produced in this way on the exterior of package.

The seriousness of these effects is itself dependent on the operating circumstances. Where elastic threads are being delivered at low speeds, the effects may be marginal. If a relatively inelastic thread is being delivered without draw rolls between the spinneret and the winder, then it is at least possible that the net result is simply a temporary change in thread titer. However, if a relatively inelastic thread is being delivered via a set of draw rolls, then any reduction in thread line tension will very rapidly lead to a lap on the draw rolls and hence to a thread break. The effects of departures from normal winding conditions are also more serious the finer the thread being wound. Finally, all effects of such departures become more serious as the delivery speed increases.

Further reference to FIG. 6 will show that the length of the interval I is determined substantially exclusively by the time required to move the chucks 24, 26. The other elements involved in a changeover are controlled to move at appropriate times within an interval determined by the chuck movements. This gives the minimum delay in re-establishment of normal winding conditions. As indicated in the detailed description of FIG. 6, this is not an essential feature but it is highly desirable at least where axial thread movement is involved in a catching operation.

Under some circumstances, especially when winding finer threads, an axial movement of the thread is not required for performance of a catching operation. For example, if the catching device comprises a radially outwardly open clamp with converging side walls, the thread may simply be moved radially of the chuck into the clamp, any slight axial deviation being corrected by the convergence of the side walls. In this case, it may be preferred to use movement of the divertor guide in order to define the instant at which the thread is carried into the clamp. For example, in terms of the diagram in FIG. 6, units C7 and C4 could operate after the expiry of period t3, so that the incoming chuck is steady in its catching position when the thread is diverted and thereby carried into the clamp. In such an arrangement, the axial movement of unit C5 could be eliminated. A shorter changeover could still be achieved, however, by moving the thread into position before the arrival of the incoming chuck into its catching position.

As already indicated in the description, the catching position of an incoming chuck is not necessarily its position of first contact with friction roll 18. The catching position will, however, certainly lie within a very short portion of the chuck path including and immediately adjacent the position of first contact. This portion may, for example, be sufficiently long to give a maximum spacing in the range 1–2 mm between the contact roll and the chuck in its catching position.

A further significant advantage of the geometry of this winder is its economy in space. This effect is represented to some extent by the illustration in FIG. 5, but not completely. That Figure represents only the relationship of the rest positions of the chucks to their positions of first contact with the contact roll. It does not take account of the paths of movement of the chucks between those positions. The fact that each chuck moves along its own independent path to and from the contact roll, and that these paths converge to a localised zone on the roll also enables economy of space in the overall winder design. There would be certain advantages, for example, to use of a common, horizontal path section during formation of a package. This would avoid control problems concerned with compensation of gravity effects on the contact pressure during winding on the upper and lower chucks respectively. However, the use of such a common horizontal path section would severely reduce the efficiency of space utilization in the machine. An additional advantage in this respect is obtained by the use of swing arms to move the chucks to and from the contact roll, together with the advantage of the use of a rotation bearing to support each chuck during its movement. The convergence of the chuck path to a localized zone on the contact roll provides the further advantage that the machine can produce large packages with a roll of relatively small diameter, as indicated above in the discussion of FIG. 4. Not only does a larger contact roll itself take-up more space in the machine but also, as previously indicated a larger contact roll is relatively undesirable for a print-type system. Furthermore, an increase in the contact roll diameter must be associated with an increase in the so-called "drag length", i.e. the free length of thread which inevitably arises between the thread guide of traverse mechanism 22 and the point X (FIG. 5) of first contact with the contact roller 18 during a normal winding operation.

The gap between the sub-zones of the winding zone is preferably kept as small as possible both because it represents "unused" space in the most critical region of the machine and because an increase in this gap moves the incoming chuck further away from the thread length it has to intercept. This latter effect in turn calls for an increase in the diversion of the thread to make interception possible. However, as chuck diameter increases, it becomes increasingly difficult to eliminate the gap between the sub-zones without accepting other undesirable features, such as longer swingarms. A maximum gap represented by an arc of 5° on the contact roller surface is an acceptable compromise, and can accomodate current package (chuck) requirements without radical changes in machine layout and dimensions. It is believed undesirable to increase the gap above 20° to accomodate still larger chucks and packages—the machine will gradually become unwieldy with larger gaps and the degree of interference of the thread guides in the thread path at changeover will become unacceptable.

What is claimed is:

1. A winder for thread comprising a contact member rotatable about a longitudinal axis thereof for receiving a travelling thread and having a winding zone for delivering a thread therefrom;

a first chuck rotatable about a longitudinal chuck axis and movable along a first path from a first rest position spaced from said member to a winding position adjacent a first sub-zone of said winding zone of said member to receive and wind a thread from said first sub-zone into a thread package on the chuck and movable along said first path to return to said rest position;

a second chuck rotatable about a longitudinal chuck axis and movable along a second path from a second rest position to a winding position adjacent a second sub-zone of said winding zone spaced from said first sub-zone to receive and wind a thread package on said second chuck and movable along said second path to return to said second rest position;

said first and second rest positions being disposed on opposite sides of a plane passing through said axis of said contact member and through said winding zone with said paths converging towards said winding zone; and said sub-zones being separated by an arc on the surface of said contact member subtending up to 20 degrees at the longitudinal axis of said contact member.

2. A winder as set forth in claim 1 wherein said arc subtends a maximum of 5 degrees at said longitudinal axis.

3. A winder as set forth in claim 1 wherein said winding zone subtends an angle of up to 100 degrees at the longitudinal axis of said contact member.

4. A winder as set forth in claim 3 wherein said winding zone subtends an angle of up to 70 degrees at said longitudinal axis.

5. A winder as set forth in claim 1 further comprising a first guide movable between a retracted position spaced from an accessible length of thread extending between a package on said first chuck and said contact member and an operative position to divert said length of thread for engagement thereof with said second chuck when said second chuck is located on a predetermined portion of said second path, and a second guide movable between a retracted position spaced from an accessible length of thread extending between a package on said second chuck and said contact member and an operative position to divert the latter length of thread for engagement with said first chuck when said first chuck is located on a predetermined portion of said first path.

6. A winder as set forth in any of claims 1, 2, 3, 4, 5 wherein said contact member is a friction drive roll having an external diameter less than 150 mm.

7. A winder as set forth in claim 6 wherein said friction drive roll has an external diameter in the range of from 100 to 125 mm.

8. A winder as set forth in any of claims 1, 2, 3, 4, 5 wherein said contact member is a contact roll, and each chuck has a drive independent of contact with said roll, the external diameter of said roll lying in the range of from 60 to 80 mm.

9. A winder as set forth in any of claims 1, 2, 3, 4, 5 wherein the included angle between imaginary lines joining the axis of each chuck in its respective rest position to the axis of the same chuck in its position of first contact with said contact member lies in a range of from 60 to 175 degrees.

10. A winder of set forth in claim 9 wherein said included angle lies in the range 140±20 degrees.

11. A winder for thread comprising a contact member rotatable about a longitudinal axis thereof for receiving a travelling thread and having a winding zone for delivering the thread therefrom, a first chuck rotatable about a longitudinal chuck axis and movable along a first path from a first rest position spaced from said member to a winding position adjacent a first sub-zone of said winding zone of said member to receive and wind a thread from said first sub-zone into a thread package on the chuck and movable along said first path to return to said rest position, a second chuck rotatable about a longitudinal chuck axis and movable along a second path from a second rest position to a winding position adjacent a second sub-zone of said winding zone spaced from said first sub-zone to receive and wind a thread package on said second chuck and movable along said second path to return to said second rest position, said first and second rest positions being disposed on opposite sides of a plane passing through said axis of said contact member and through said winding zone with said paths converging towards said winding zone, a first guide movable between a retracted position spaced from an accessible length of thread extending between a package on said first chuck and said contact member and an operative position to divert said length of thread over an angle of diversion not in excess of 120° for engagement thereof with said second chuck when said second chuck is lcoated on a predetermined portion of said second path, and a second guide movable between a retracted position spaced from an accessible length of thread extending between a package on said second chuck and said contact member and an operative position to divert the latter length of thread over an angle of diversion not in excess of 120° for engagement with said first chuck when said first chuck is located on a predetermined portion of said first path.

12. A winder as set forth in claim 11 wherein said winding zone subtends an angle of up to 100 degrees at the longitudinal axis of said contact member.

13. A winder as set forth in claim 12 wherein said winding zone subtends an angle of up to 70 degrees at said longitudinal axis.

14. A winder as set forth in claim 11 wherein said angle of diversion does not exceed 100 degrees.

15. A winder as set forth in any of claims 11 to 14 wherein said contact member is a friction drive roll having an external diameter less than 150 mm.

16. A winder as set forth in claim 15 wherein said friction drive roll has an external diameter in the range of from 100 to 125 mm.

17. A winder as set forth in any of claims 11 to 14 wherein said contact member is a contact roll, and each chuck has a drive independent of contact with said roll, the external diameter of said roll lying in the range of from 60 to 80 mm.

18. A winder as set forth in any of claims 11 to 14 wherein the included angle between imaginary lines joining the axis of each chuck in its respective rest position to the axis of the same chuck in its position of first contact with said contact member lies in a range of from 60 to 175 degrees.

19. A winder as set forth in claim 18 wherein said included angle lies in the range 140±20 degrees.

20. A winder for thread comprising a contact member rotatable about a longitudinal axis thereof for receiving a travelling thread and having a winding zone for delivering the thread therefrom;

a first chuck rotatable about a longitudinal chuck axis and movable along a first path from a first rest position spaced from said member to a winding position adjacent a first sub-zone of said winding zone of said member to receive and wind a thread from said first sub-zone into a thread package on the chuck and movable along said first path to return to said rest position;

a second chuck rotatable about a longitudinal chuck axis and movable along a second path from a second rest position to a winding position adjacent a second sub-zone of said winding zone spaced from said first sub-zone to receive and wind a thread package on said second chuck and movable along said second path to return to said second rest position;

said first and second rest positions being disposed on opposite sides of a plane passing through said axis of said contact member and through said winding zone with said paths converging towards said winding zone;

a first guide movable between a retracted position spaced from an accessible length of thread extending between a package on said first chuck and said contact member and an operative position to divert said length of thread for engagement thereof with said second chuck when said second chuck is located on a predetermined portion of said second path, said first guide being positioned between said contact member and said incoming second chuck in said operative position thereof to increase the angle of wrap of the thread on said contact member; and a second guide movable between a retracted position spaced from an accessible length of thread extending between a package on said second chuck and said contact member and an operative position to divert the latter length of thread for engagement with said first chuck when said first chuck is located on a predetermined portion of said first path.

21. A winder as set forth in claim 20 wherein said sub-zones are separated by an arc on the surface of said contact member subtending up to 20 degrees at the longitudinal axis of said contact member.

22. A winder as set forth in claim 21 wherein said arc subtends a maximum of 5 degrees at said longitudinal axis.

23. A winder as set forth in claim 20 wherein said winding zone subtends an angle of up to 100 degrees at the longitudinal axis of said contact member.

24. A winder as set forth in claim 23 wherein said winding zone subtends an angle of up to 70 degrees at said longitudinal axis.

25. A winder as set forth in claim 20 wherein each guide is disposed in said operative position to divert a thread length over an angle of diversion not in excess of 120 degrees.

26. A winder as set forth in claim 25 wherein said angle of diversion does not exceed 100 degrees.

27. A winder as set forth in any of claims 20 to 26 wherein said contact member is a friction drive roll having an external diameter less than 150 mm.

28. A winder as set forth in claim 27 wherein said friction drive roll has an external diameter in the range of from 100 to 125 mm.

29. A winder as set forth in any of claims 20 to 26 wherein said contact member is a contact roll, and each chuck has a drive independent of contact with said roll, the external diameter of said roll lying the range of from 60 to 80 mm.

30. A winder as set forth in any of claims 20 to 26 wherein the included angle between imaginary lines joining the axis of each chuck in its respective rest position to the axis of the same chuck in its position of first contact with said contact member lies in a range of from 60 to 175 degrees.

31. A winder as set forth in claim 30 wherein said included angle lies in the range 140±20 degrees.

32. A winder for thread comprising a contact member rotatable about a longitudinal axis thereof for receiving a travelling thread and having a winding zone for delivering the thread therefrom;

a first chuck rotatable about a longitudinal chuck axis and movable along a first path from a first rest position spaced from said member to a winding position adjacent a first sub-zone of said winding zone of said member to receive and wind a thread from said first sub-zone into a thread package on the chuck and movable along said first path to return to said rest position;

a second chuck rotatable about a longitudinal chuck axis and movable along a second path from a second rest position to a winding position adjacent a second sub-zone of said winding zone spaced from said first sub-zone to receive and wind a thread package on said second chuck and movable along said second path to said second rest position;

said first and second rest positions being disposed on opposite sides of a plane passing through said axis of said contact member and through said winding zone with said paths converging towards said winding zone and the included angle between imaginary lines joining the axis of each chuck in its respective rest position to the axis of the same chuck in its position of first contact with said contact member lies in a range of from 60 to 175 degrees.

33. A winder as set forth in claim 32 wherein said included angle lies in the range 140±20 degrees.

* * * * *